US010507350B1

(12) United States Patent
Janov

(10) Patent No.: US 10,507,350 B1
(45) Date of Patent: Dec. 17, 2019

(54) STRAP MADE OF SOFT NON-STRETCHABLE MATERIAL TO STRETCH MUSCLES, TENDONS, JOINTS, CAPSULES, LIGAMENTS OF POSTERIOR AND ANTERIOR LOWER EXTREMITIES

(71) Applicant: Daniel Janov, Calabasas, CA (US)

(72) Inventor: Daniel Janov, Calabasas, CA (US)

( * ) Notice: Subject to any disclaimer, the term of this patent is extended or adjusted under 35 U.S.C. 154(b) by 46 days.

(21) Appl. No.: 15/011,406

(22) Filed: Jan. 29, 2016

(51) Int. Cl.
*A63B 21/00* (2006.01)
*A63B 23/035* (2006.01)
*A63B 23/00* (2006.01)

(52) U.S. Cl.
CPC .... *A63B 21/00185* (2013.01); *A63B 23/0355* (2013.01); *A63B 2023/006* (2013.01)

(58) Field of Classification Search
CPC ..... A63B 2023/006; A63B 21/0023; A63B 21/002; A63B 21/00185; A63B 21/055; A63B 21/000043; A63B 23/025; A63B 7/00; A63B 7/02; A45F 2005/1013
USPC ..... 607/96; 224/129, 164, 175, 219, 629, 224/250; 294/150
See application file for complete search history.

(56) References Cited

U.S. PATENT DOCUMENTS 3,364,511 A * 1/1968 Martin ..... A47K 7/022 15/222
3,625,559 A * 12/1971 Lawrence ..... B66C 1/18 294/74
3,868,137 A * 2/1975 Friend ..... B66C 1/18 294/74
3,875,933 A * 4/1975 Schwab ..... A61H 11/00 15/222
4,915,096 A * 4/1990 Winstone ..... A61H 11/00 128/DIG. 15
4,969,644 A * 11/1990 Hlaing ..... A63B 21/0004 482/126
5,518,486 A 5/1996 Sheeler
D380,050 S * 6/1997 Cappelli ..... D24/206
5,762,242 A * 6/1998 Yost ..... A63C 11/021 224/250
6,076,874 A * 6/2000 Lovette ..... A45F 5/10 294/150
6,227,742 B1 * 5/2001 Corn ..... A47K 7/022 15/208
D457,725 S * 5/2002 Parsons ..... D3/327
6,849,055 B1 * 2/2005 Williams ..... A47K 7/022 15/208
7,007,705 B1 3/2006 Thrower
7,503,883 B2 3/2009 Madden
7,794,374 B1 9/2010 Park
8,343,018 B2 1/2013 Moulton
(Continued)

*Primary Examiner* — Nyca T Nguyen
(74) *Attorney, Agent, or Firm* — Thomas I. Rozsa

(57) ABSTRACT

A soft stretching apparatus made of cotton, terry cloth, wool, felt or non-stretchable neoprene. The stretching apparatus includes a length of cloth having a first end and a second end with a first retaining member affixed at the first end of the length of cloth and having a fixed circumferential frame enclosing a first opening between the frame and the first end of the length of cloth, and the cloth having a second end with a second retaining member affixed at the second end of the length of cloth and having a fixed circumferential frame enclosing a second opening between the frame and the second end of the length of cloth.

4 Claims, 13 Drawing Sheets

(56) References Cited

U.S. PATENT DOCUMENTS

| | | | | |
|---|---|---|---|---|
| 8,454,484 | B2 * | 6/2013 | Keen | A63B 21/02 224/218 |
| 2005/0239604 | A1 * | 10/2005 | Denham | A45F 4/00 482/23 |
| 2005/0271857 | A1 * | 12/2005 | Brody | A63B 21/0004 428/78 |
| 2007/0265145 | A1 | 11/2007 | Teng | |
| 2008/0116239 | A1 * | 5/2008 | Lu | A45C 13/30 224/575 |
| 2010/0048366 | A1 * | 2/2010 | Lebert | A63B 21/0023 482/126 |
| 2011/0094011 | A1 * | 4/2011 | Klekamp | A63B 21/4021 2/170 |
| 2011/0118094 | A1 | 5/2011 | Kissner et al. | |
| 2012/0040808 | A1 | 2/2012 | Khademi | |
| 2012/0322626 | A1 * | 12/2012 | Meimaroglou | A63B 23/03541 482/92 |
| 2014/0018216 | A1 | 1/2014 | Hatfield | |
| 2014/0024508 | A1 * | 1/2014 | Hinds | A63B 21/02 482/129 |

* cited by examiner

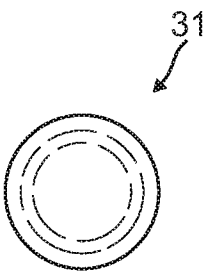
FIG. 1AAA
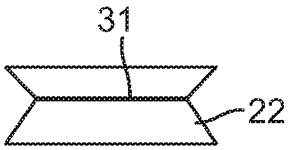
FIG. 1BBB
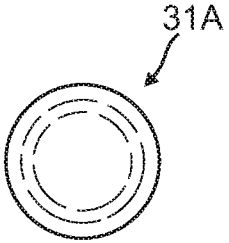
FIG. 1AAAA
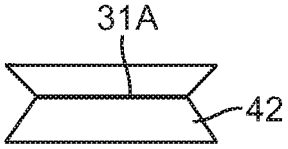
FIG. 1BBBB

STRAP MADE OF SOFT NON-STRETCHABLE MATERIAL TO STRETCH MUSCLES, TENDONS, JOINTS, CAPSULES, LIGAMENTS OF POSTERIOR AND ANTERIOR LOWER EXTREMITIES

BACKGROUND OF THE INVENTION

1. Field of the Invention

The present invention relates to the field of exercise apparatus which are used to enable a person to stretch muscles, especially muscles which become tight due to various causes.

2. Description of the Prior Art

The following nine patents and published patent applications are the closest prior art known to the inventor.

1. U.S. Pat. No. 5,518,486 issued to Judith M. Sheeler on May 21, 1996 for "Exercise Strap Device" (hereafter the "Sheeler Patent");
2. U.S. Pat. No. 7,007,705 issued to Martha Thrower on Mar. 7, 2006 for "Foot Mobility Aid" (hereafter the "Thrower Patent");
3. United States Published Patent Application No. 2007/0265145 to Ju-Chuan Teng on Nov. 15, 2007 for "Pull Exerciser with Stepless Length Adjustment" (hereafter the "Teng Published Patent Application");
4. U.S. Pat. No. 7,503,883 issued to Michael J. Madden on Mar. 17, 2009 for "Resistance Exercise Device" (hereafter the "Madden Patent");
5. U.S. Pat. No. 7,794,374 issued to Othilli Park on Sep. 14, 2010 for "Elastic Device" (hereafter the "Park Patent");
6. United States Published Patent Application No. 2011/0118094 to Wendell L. Kissner et al. on May 19, 2011 for "Leg Muscle Stretcher" (hereafter the "Kissner Published Patent Application");
7. United States Published Patent Application No. 2012/0040808 to Ehsan Khademi on Feb. 16, 2012 for "Stretching and Exercise Device and Method" (hereafter the "Khademi Published Patent Application");
8. U.S. Pat. No. 8,343,018 issued to Kelly J. Moulton on Jan. 1, 2013 for "Muscle Tension Strap" (hereafter the "Moulton Patent");
9. United States Published Patent Application No. 2014/0018216 to Keith Howard Hatfield on Jan. 16, 2014 for "Device and Method for Passive Flexibility Training" (hereafter the "Hatfield Published Patent Application").

The Sheeler Patent discloses an exercise strap used to perform various stretching exercises with preformed grasping members to be held by a hand or placed around a body part. The strap is made of elastic stretchable material.

The Teng published patent application discloses a belt with a multiplicity of preformed loops on opposite ends of the belt to facilitate stretching body parts.

The Thrower patent discloses a "Foot Mobility Aid" which helps a person with limited mobility to move their foot. Referring to Column 3, beginning on Line 61, and continuing to Column 4, the patent discloses:

"A first of the ends 11 of the strap is folded back over an adjacent portion of the strap and coupled to the adjacent portion of the strap to form a foot loop 17 adjacent the first end of the strap. As illustrated in FIG. 2, the foot loop is designed for extending the foot 18 of a user therein such that the arch region of the user's foot is positioned in the foot loop. Ideally, a buckle 19 detachably couples the first end of the strap to the adjacent portion of the strap to permit adjusting of the size of the foot loop. The buckle is fixedly coupled to the adjacent portion of the strap and preferably has an end loop 20 for extending the first end of the strap therein."

The Madden Patent discloses a resistance exercise device with preformed hand grasping members between a cord.

The Park Patent discloses an "Elastic Device". The patent text in Column 3, beginning on Line 11 and continuing to Line 22, discloses:

"FIGS. 3 and 4 also illustrate separate embodiments of the elastic device of the present invention. Both of these embodiments employ a strap 10 that may also be formed in a loop and is for supporting at the very end of the connector either a handle 3 as illustrated in FIG. 4 or a clip 4 as illustrated in FIG. 3. The handle 3 is preferably hollow so the strap can pass therethrough. The strap may be a single piece woven plastic material that is attached at its ends into a loop form. The very ends of the sleeve 20 are preferably stitched to the strap 10. In addition to the handle 3 and the clip 4 that are illustrated herein, numerous other connector arrangements may be used with the elastic device of the present invention."

The Kissner Published Patent Application discloses a "Leg Muscle Stretcher". The patent application discloses:

"The leg muscle stretcher is a device for stretching the leg muscle to alleviate cramping. The leg muscle stretcher includes three parts, including a handle, a strap and a foot mat. The strap is adjustable in length to accommodate users of different heights."

The Khademi Published Patent Application discloses a "Stretching And Exercise Device And Method". The patent discloses:

"A stretching and exercise device has a first strap member having a pair of end portions, a second strap member having a pair of end portions, and a pair of resistance members connected between respective end portions of the first and second strap members. A third strap member has a pair of end portions attached to respective first and second surface portions of the second strap member. A fourth strap member is attached to a third surface portion of the second strap member different from the first and second surface portions thereof."

The Moulton Patent issued discloses a "Muscle Tension Strap". The patent discloses:

"A muscle tension strap including a pair of elongated flat bands each formed of substantially non-resilient material. The pair of flat bands are affixed together at a plurality of intermediate points therealong to form a plurality of tandem loops. The plurality of intermediate points at which the pair of elongated flat bands are affixed together are in a range of four to seven. Portions of each flat band adjacent each end are affixed together in overlying relationship to form a final loop with a handle therein and the pair of flat bands have a length in a range of five feet to seven feet."

Thee Hatfield Published Patent Application as filed in July 2013 and was published on Jan. 16, 2014 and is still pending. It discloses a "Device And Method For Passive Flexibility Training.

While the general concept of a stretching device is known, none of the prior art devices provide a stretching device which is made of non-stretchable material and which is capable of being folded in on itself to enable stretching of various body parts.

SUMMARY OF THE INVENTION

It is an object of the present invention to have a soft stretching apparatus made of soft cloth material selected from the group consisting of cotton, terry cloth, wool, felt, and non-stretchable neoprene and used for stretching all muscles, tendons, joints, capsules, ligaments of posterior, anterior, medial and interior lower extremities of the foot, ankle, knee and hip and upper extremities including arms and shoulders. The stretching apparatus includes a length of cloth having a first end and a second end with a first retaining member affixed at the first end of the length of cloth and having a fixed circumferential frame enclosing a first opening between the frame and the first end of the length of cloth, and the cloth having a second end with a second retaining member affixed at the second end of the length of cloth and having a fixed circumferential frame enclosing a second opening between the frame and the second end of the length of cloth.

It is an additional of the present invention exercise apparatus to include a length of non-stretchable material having a first end and a second end. The first end has a first arcuate closed loop retaining member retained at a first end of the length of cloth. In one embodiment of the present invention, the first arcuate closed loop retaining member includes a curved section with integrally formed side sections with a straight base integrally formed with and retained between the side sections and surrounding first opening The first end of the length of cloth has an interior channel in which the straight base section is retained. The first arcuate closed loop retaining member is made of soft, flexible material selected from the group consisting of cotton, polyvinyl and other soft material which will retain its shape but will not cut into the skin, cause skin irritation or cause grip fatigue.

The length of exercise strap material of the present invention exercise apparatus also has a second end including a second arcuate closed loop retaining member retained at the second end. In one embodiment of the present invention, the second arcuate closed loop retaining member includes a curved section with integrally formed side sections with a straight base integrally formed with and retained between the side sections and surrounding a second opening.

The second end has a corresponding second arcuate closed loop retaining member which is identical to the first closed loop retaining member. The second end of the exercise apparatus also has an interior channel into which the straight base section is retained. The second arcuate closed loop retaining member is made of soft flexible material such as cotton, polyvinyl and other soft material which can retain its shape but will not cut into the skin, cause skin irritation or cause grip fatigue.

The second closed loop arcuate retaining member includes a closed loop section with integrally formed side sections with a straight base section integrally formed with and retained between the side sections and surrounding the second opening. The second end of the exercise apparatus also has an interior channel in which the straight base section of the second arcuate closed loop member is retained. The first and second arcuate closed loop retaining members are examples of end members and other retaining members are within the spirit and scope of the present invention. The second arcuate closed loop retaining member is made of soft flexible material such as cotton, polyvinyl and other soft material which can retain its shape but will not cut into the skin, cause skin irritation or cause grip fatigue.

It is within the spirit and scope of the present invention for the first retaining member to be a closed loop. As described, the first end of the exercise apparatus has an interior channel with a portion of the first closed loop retained within the interior channel. It is also within the spirit and scope of the present invention for the second retaining member to be a closed loop. As described, the second end of the exercise apparatus has an interior channel into which a portion of second closed loop retaining member is retained. The first and second closed loop can also be made of the same material as the embodiments of the closed loop having the arcuate section, pair of legs and base.

It is a further object of the present invention for both the length of cloth and both closed loop retaining members to made of towel material so that they are non-stretchable but are soft and will not cut skin and will also not create grip fatigue as they as they are being used.

The main object and primary focus and benefit of the present invention flexible non-stretchable strap is to stretch muscles, tendons and ligaments.

It is also a key object of the present invention to facilitate stretching and lengthening all types of post structures of the leg, which includes lengthening a muscle.

The first retaining member is also made of soft fabric material so that it can be handled and create a surface which will not create skin irritation or cause grip fatigue. In addition, the present invention will at least minimize any skin irritation and will minimize fatigue while re-gripping the closed loop section.

The second retaining member includes a closed loop section covered by the strap and extending to two integrally formed spaced apart parallel legs, with an integrally formed base extending between the two integrally formed spaced apart parallel legs, second section opening within the closed loop section, the two integrally formed spaced apart legs and base, the second interior channel with the length of cloth adjacent the second end of the length of cloth with the base of the second section member retained within the closed loop section.

It is also an object of the present invention to create any configuration where the cloth is at least partially wrapped around a body part adjacent one end and a pulling force is exerted on the cloth at an opposite end to stretch muscles of a body part around which the cloth has been at least partially wrapped.

It is also an object of the present invention to provide an apparatus to stretch muscles, tendons, joints, capsules, ligaments of posterior, anterior, medial and interior lower extremities of the foot and ankle wherein such a body part has become tight such as calves, muscles of the legs and arms as well tendons and ligaments in the arms and legs.

It is also an object of the present invention to provide a stretching apparatus which avoids cutting into the skin, minimizes skin irritations and minimizes grip fatigue.

It is a further object of the present invention to enable the stretching apparatus to be washable and reused over and over without shrinking or losing its beneficial properties.

It is an additional object of the present invention to provide an apparatus made of a length of non-stretchable cloth with retaining members at opposite ends of the length of cloth.

Defined in detail, the present invention is an apparatus used in conjunction with body parts to stretch portions of body parts, the apparatus comprising: (a) a length of non-stretchable materia having a first end and having a first interior channel adjacent the first end and a second end having a second interior channel adjacent the second end; (b) a first gripping member made of non-stretchable material and formed in a closed loop surrounding an opening, a portion of the closed loop retained in the first interior channel at the first length of non-stretchable material; and (c) a second gripping member at a second end made of non-stretchable material made of non-stretchable material and formed in a closed loop surrounding an opening, a portion of the closed loop retained in the first interior channel at the first length of non-stretchable material; (d) whereby, a portion adjacent the first end of the length of non-stretchable material is extended through the first opening in the gripping member and thereafter, the length of non-stretchable material is wrapped around a first body part and a portion of the length of material adjacent the second end is extended through the second opening in the second closed loop of the second gripping member and extended around and over a second body part and thereafter the length of non-stretchable material is retained and gripped by both hands to perform a stretching exercise of muscles and tendons located at different areas of a body.

Defined more broadly, the present invention is an apparatus to enable stretching, the apparatus used in conjunction with a leg of a person, the leg of the person including a bottom of a foot extending from a heel and toes of the foot with a tibia including an ankle, the tibia flexibly connected to a femur, the tibia including muscles, the person having at least a first hand and a first wrist of a first forearm and at least a second hand and a second wrist of a second forearm, the stretching apparatus comprising: (a) a length of non-stretchable length of cloth material having a first length and having a first termination of the non-stretchable length of cloth at a first end and having a second termination of the non-stretchable length of cloth at a second end, the first end having a first retaining member retained at the first end of the non-stretchable length of cloth, the first retaining member having a first opening, the second end having a second retaining member retained at the second end of the non-stretchable length of cloth, the second retaining member having a second opening; and (b) the non-stretchable length of cloth made of flexible and non-stretchable material enabling a portion of a second non-stretchable length of cloth extending from the first end to be folded back on itself and inserted through the first opening of the first retaining member to create a first cloth opening adjacent the first end, the flexible and non-stretchable length of material enabling a portion of a third non-stretchable length of cloth extending from the second end to be folded back on itself and inserted through the second opening of the second retaining member to create a second cloth opening; (c) whereby, the second hand and second wrist is inserted through the first cloth opening and the adjacent length of cloth is gripped by the second hand and the foot and ankle of a leg at a body part opposite the location of the second wrist and hand is inserted through the second cloth opening and the second portion of length of cloth is wrapped around the ankle and extended from the heel to the toes and grasped by a second hand to create a stretching of the muscles of the tibia.

Alternatively defined more broadly, the present invention is an apparatus to enable stretching, the apparatus used in conjunction with a first arm of a person, the first arm of the person including an upper arm with muscles, a first forearm with a first hand and a first wrist of a first forearm and also including a second forearm with a second hand, and used in conjunction with a shoulder and a back of the person, the stretching apparatus comprising: (a) a length of cloth material having a first length and having a first termination of the length of cloth at a first end and having a second termination of the length of cloth at a second end, the first end having a first retaining member retained at the first end of the length of cloth, the first retaining member having a first opening, the second end having a second retaining member retained at the second end of the length of cloth, the second retaining member having a second opening; and (b) the length of cloth made of flexible and non-stretchable material enabling a second length of cloth extending from the first end to be folded back on itself and inserted through the first opening of the first retaining member to create a first cloth opening adjacent the first end; (c) whereby the apparatus to enable stretching is used in conjunction with the first arm enabling the first hand's and first wrist insertion through the first cloth opening with a portion of the second length of cloth wrapped around the first wrist, the apparatus to enable stretching used in conjunction with muscles of first upper arm to create a stretching of the muscles of the first upper arm by the person placing the first arm behind the person's back and extending the length of coth over a shoulder and grasping the second end of the length of cloth by the person's second hand, with the second hand exerting a pulling force on the length of cloth with the second length of cloth wrapped around the first wrist, the non-stretchable feature of the length of cloth facilitating a stretching of the muscles of the first upper arm.

The present invention is also defined as a method to enable stretching of a body part used in conjunction with a body part of a person, the body part to be stretched located at a first location and including muscles for stretching, the body having a second body part with a hand for grasping, the method comprising: (a) obtaining a length of cloth material having a first length and having a first termination of the length of cloth at a first end and having a second termination of the length of cloth at a second end, the first end having a first retaining member retained at the first end of the length of cloth, the first retaining member having a first opening; and (b) the length of cloth being made of flexible and non-stretchable material, causing a second length of cloth extending from the first end to be folded back on itself and inserted through the first opening of the first retaining member to create a first cloth opening adjacent the first end; and (c) inserting the body part with muscles for stretching into the first cloth opening and wrapping the second length of cloth around the body part for stretching and grasping the second end of the length of cloth with the second hand having a hand for grasping and exerting a pulling force on the length of cloth from the hand for grasping the non-stretchable feature of the length of cloth facilitating a stretching of the body part.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1AA is a side view of the second arcuate retaining member;

FIG. 1BB is a cross-sectional view taken along line 1BB-1BB of FIG. 1;

FIG. 1AAA is a side view of the third retaining member;

FIG. 1BBB is a cross-sectional view taken along the equivalent of Line 1B-1B of FIG. 1 illustrating the closed loop portion illustrated in FIG. 1AAA extending therethrough;

FIG. 1AAAA is a side view of the fourth retaining member;

FIG. 1BBBB is a cross-sectional view taken along the equivalent of Line 1BB-1BB of FIG. 1, illustrating the closed loop of FIG. 1AAAA inserted therethrough;

DETAILED DESCRIPTION OF EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
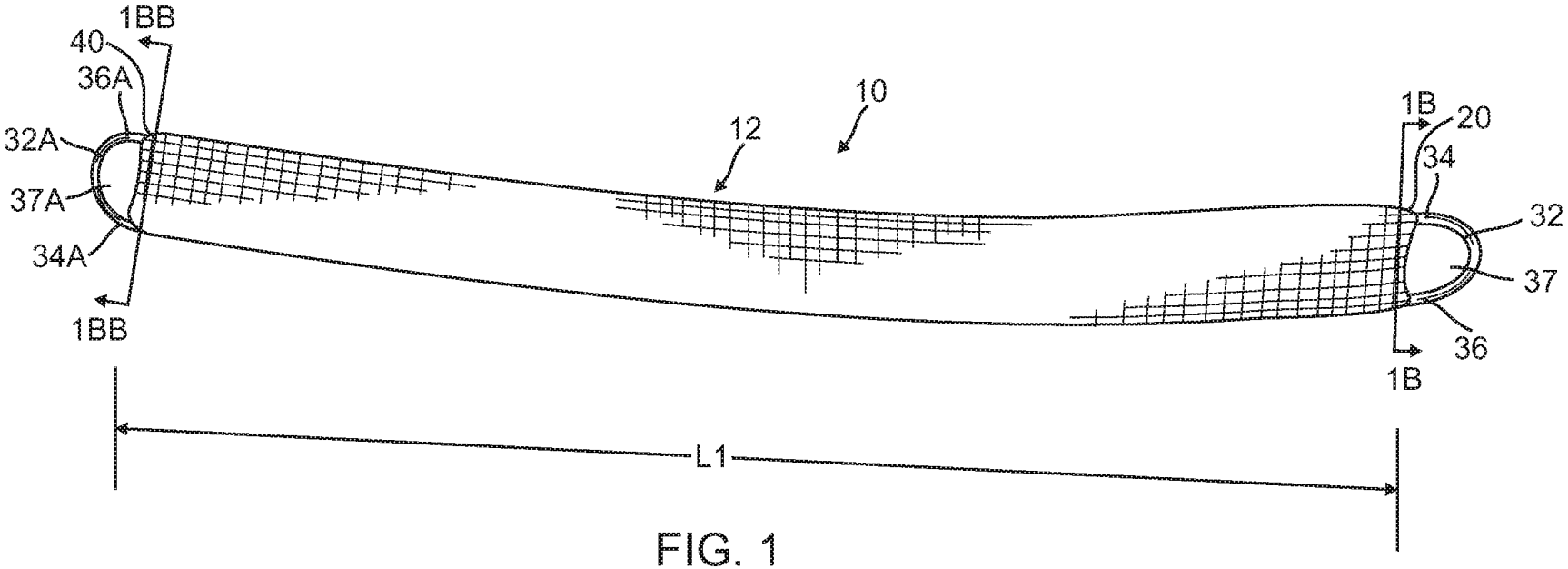
FIG. 1 is a side perspective view of the present invention exercise apparatus made of cloth material which is not stretchable and used for stretching connective tissues, muscles, tendons, joints, capsules, ligaments of posterior, anterior, medial and interior lower extremities of the foot and ankle, the exercise apparatus including a length of cloth having a first end and a second end with a closed loop apparatus retaining member affixed at the first end of the length of cloth and having a soft circumferential frame enclosing a first opening between the frame and the first end of the length of cloth, and the cloth having a second end with a second closed loop apparatus retaining member affixed at the second end of the length of cloth and having a soft circumferential frame enclosing a second opening between the frame and the second end of the length of cloth.
Figure 1A:
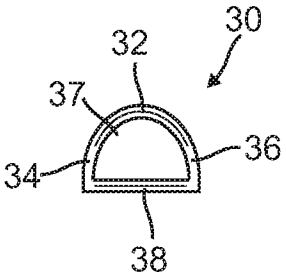
FIG. 1A is a side view of the first arcuate retaining member.
Figure 1B:
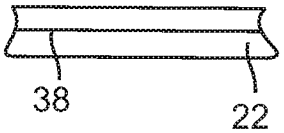
FIG. 1B is a cross-sectional view taken along line 1B-1B of FIG. 1.
Figure 1A:
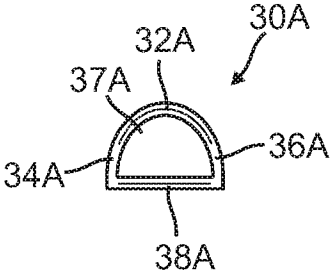
Figure 1B:
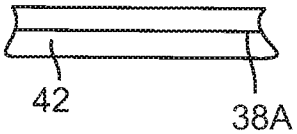

Referring to FIG. 1, FIG. 1A and FIG. 1B, there is illustrated is a side perspective view of the present invention exercise apparatus 10 made of non-stretchable material 12 selected from the group consisting of cotton, terry cloth, wool and non-stretchable neoprene and used for stretching muscles, tendons, joints, capsules, ligaments of posterior and anterior lower extremities of the foot and ankle. The exercise apparatus 10 includes a length "L1" of non-stretchable material having a first end 20 and a second end 40. The first end 20 has a first closed loop retaining member 30 retained at a first end 20 of the length of cloth 12.

Referring to FIG. 1A, in one embodiment of the present invention, the first arcuate closed loop retaining member 30 includes a curved section 32 with integrally formed side sections 34 and 36 with a straight base 38 integrally formed with and retained between the side sections 34 and 36 and surrounding first opening 37. Referring to FIG. 1B, the first end 20 has an interior channel 22 into which the straight base section 38 is retained. The first arcuate closed loop retaining member 30 is made of soft, flexible material selected from the group consisting of cotton, polyvinyl and other soft material which will retain its shape but will not cut into the skin, cause skin irritation or cause trip fatigue.

Referring to FIG. 1B, the first end 20 has an interior channel 22 into which the straight base section 38 is retained. The first arcuate closed loop retaining member is made of soft flexible material such as cotton, polyvinyl and other soft material which can retain its shape but will not cut into the skin, cause skin irritation or cause grip fatigue.

Referring to FIG. 1, FIG. 1AA and FIG. 1BB, there is illustrated a side perspective view of the present invention exercise apparatus 10 as described above but concentrating on the second end 40.

The second end has a second arcuate closed loop retaining member 30A. The second arcuate retaining member 30A includes an arcuate section 32A with integrally formed side sections 34A and 36A with a straight base section 38A integrally formed with and retained between the side sections 34A and 36A and surrounding second opening 37A. Referring to FIG. 1BB, the second 40 end has an interior channel 42 into which the straight base section 38A is retained. The arcuate closed loop retaining members 30 and 30A are examples of end members and other retaining members are within the spirit and scope of the present invention. The second arcuate closed loop retaining member is made of soft flexible material such as cotton, polyvinyl and other soft material which can retain its shape but will not cut into the skin, cause skin irritation or cause grip fatigue.

While specifically described, it is also within the spirit and scope of the present invention to refer to each respective retaining member 30 and 32A as a closed loop retaining member and then a portion of the closed loop is retained in respective channels 22 and 42 and the opening described as 37 and 37A are within the respective closed loops 30 and 30A.

It is within the spirit and scope of the present invention for the first retaining member to be a closed loop. Referring to FIG. 1AAA, there is illustrated a side view of the first loop retaining member. As illustrated in the side view in FIG. 1AAA, it is also within the spirit and scope of the present invention for the first retaining member to be a closed loop 31. Referring to FIG. 1BBB, the first end 20 of the exercise apparatus 10 has an interior channel 22 with a portion of the closed loop 31 retained within the interior channel 22.

It is also within the spirit and scope of the present invention for the second retaining member to be a closed loop 31A as illustrated in FIG. 1AAAA. Also referring to FIG. 1BBBB, the second end 40 has an interior channel 42 into which a portion of close loop retaining member 31A is retained. The closed loops 31 and 31A can also be made of the same material as discussed for the retaining members 30 and 30A.

It is within the spirit and scope of the present invention for both the length of cloth and both closed loop retaining members to made of towel material so that they are non-stretchable but are soft and will not cut skin and will also not create grip fatigue as they as they are being used.

The key innovation is that the cloth 12 is completely flexible and can be bent and manipulated through various configurations but is not stretchable and provides a fixed resistance to a force applied at or adjacent either the first end 20 or the second end 40.

Figure 2:
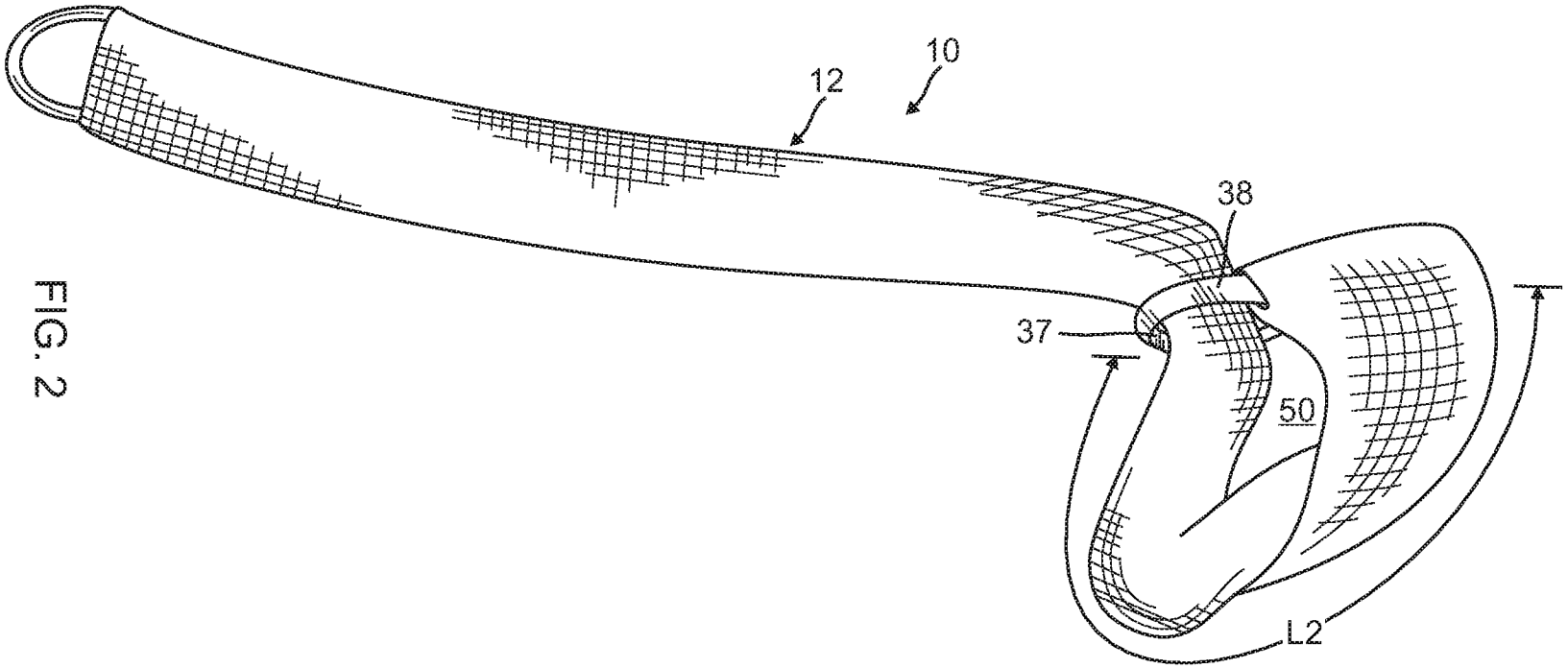
FIG. 2 is a side perspective view of the present invention illustrated in FIG. 1 with a given length of cloth folded back on itself and looped into the first opening surrounded by the first arcuate retaining member and the first end of the length of cloth to create a first cloth opening.

One configuration using the present invention to stretch calf muscles in a tibia is illustrated in FIGS. 2 through 7. Referring to FIG. 2, there is illustrated a side perspective view of the present invention exercise apparatus 10 with a given length "L2" of cloth 12 folded back on itself and looped into the first opening 38 within the first arcuate retaining member 30 to create a first cloth opening 50.

Figure 3:
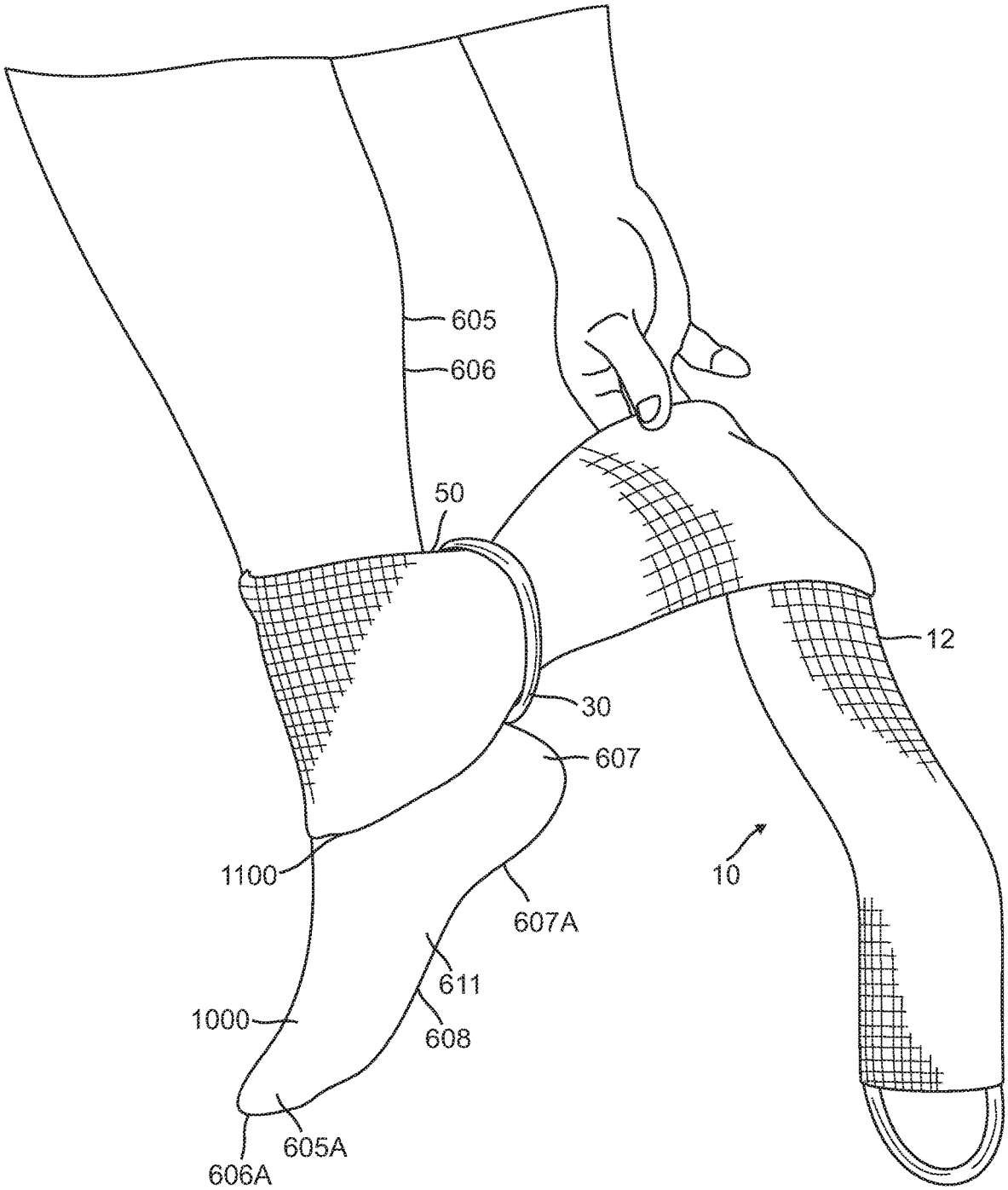
FIG. 3 is a side perspective view of the present invention illustrating a foot inserted through the first cloth opening illustrated in FIG. 2 with an ankle having a length of cloth wrapped around the ankle and the first arcuate retaining member behind the ankle.

Referring to FIG. 3, there is illustrated a side perspective view of the present invention exercise apparatus 10 illustrating a foot 1000 inserted through the first cloth opening 50 with an ankle 1100 having the length "L2" of cloth wrapped around the ankle 1100 and the first arcuate retaining member 30 behind the ankle 1000.

Figure 4:
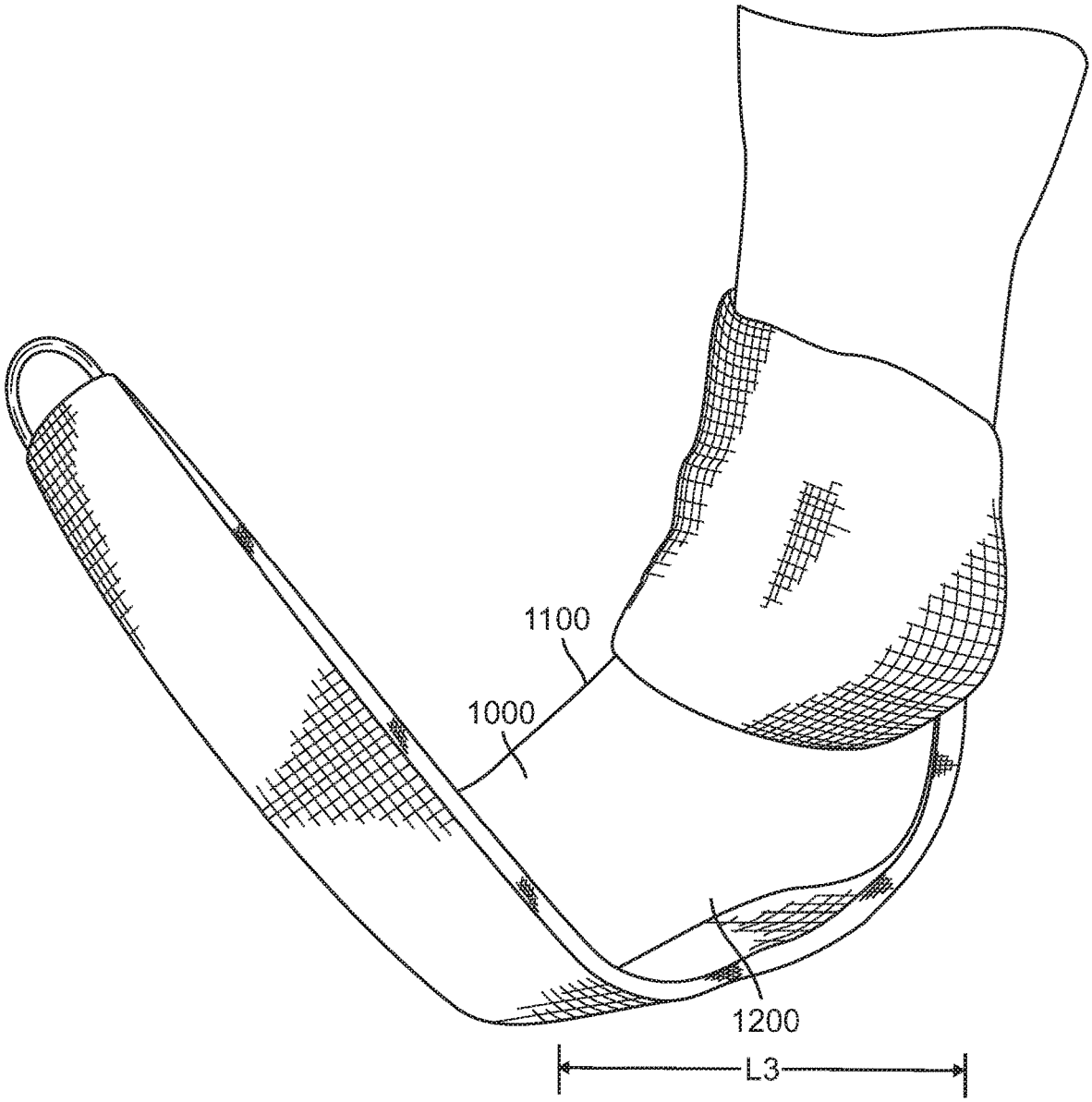
FIG. 4 is a side perspective view of the present invention illustrating the adjacent length of cloth illustrated in FIG. 3 extending from the ankle around the heel of the foot and under the foot and past the toes of the foot, the second arcuate refraining member illustrated away from the wrapped ankle.

Referring to FIG. 4, there is illustrated a side perspective view of the present invention exercise apparatus 10 illustrating the length "L3" of cloth 12 extending from the ankle 1100 around the heel 1200 of the foot 1000 and under the foot 1000 and past the toes of the foot, the second arcuate retaining member 30A illustrated away from the wrapped ankle 1100.

Figure 5:
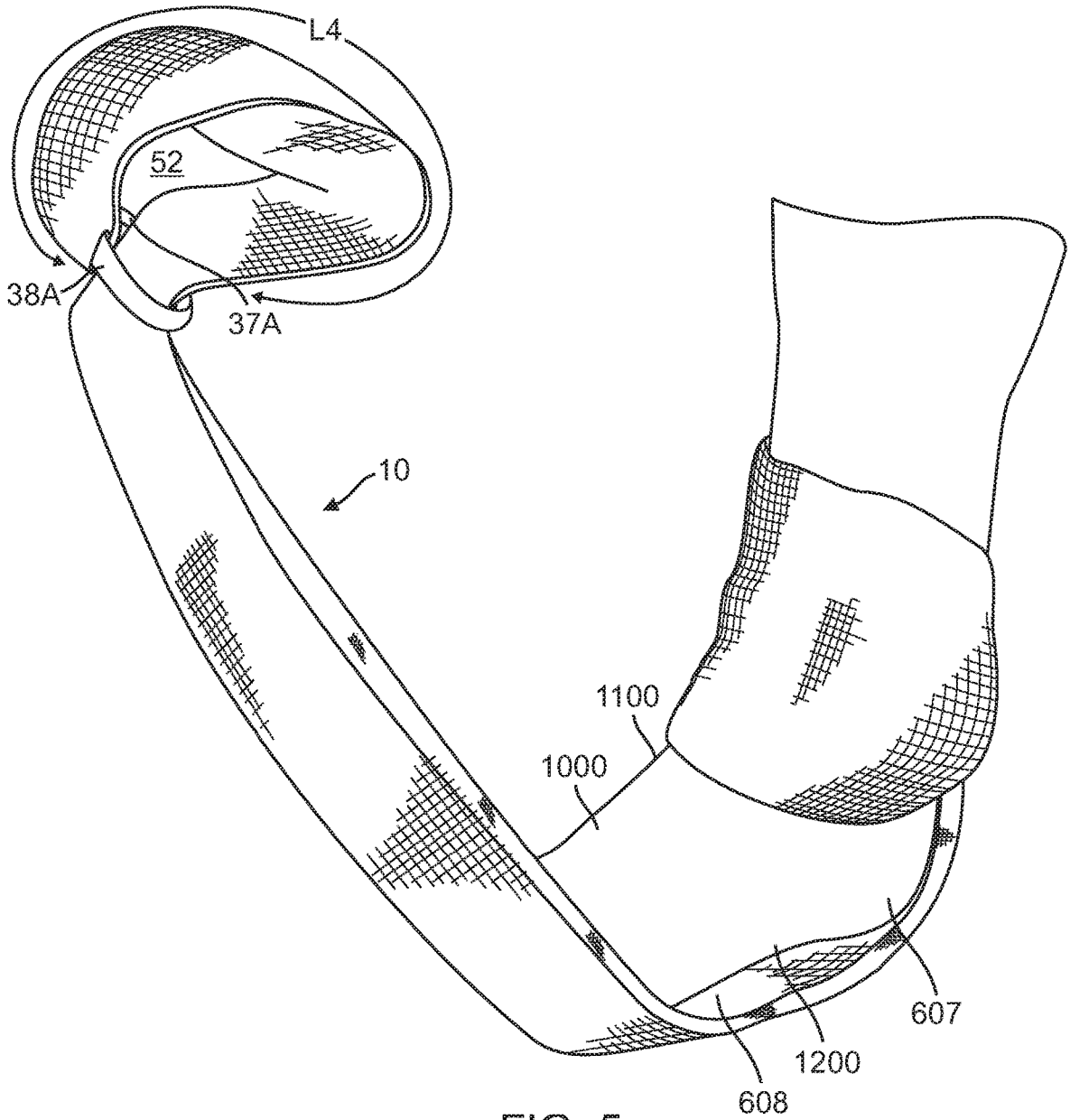
FIG. 5 is a side perspective view of the present invention taken from the view illustrated in FIG. 4, with a given length of cloth folded back on itself and looped into the second opening surrounded by the second arcuate retaining member and the second end of the length of cloth to create a second cloth opening.

Referring to FIG. 5, there is illustrated a side perspective view of the present invention exercise apparatus 10 taken from the view illustrated in FIG. 4, with a given length "L4" of cloth 12 folded back on itself and looped into the second opening 37A of the second arcuate retaining member 30A to create a second cloth opening 52.

Figure 6:
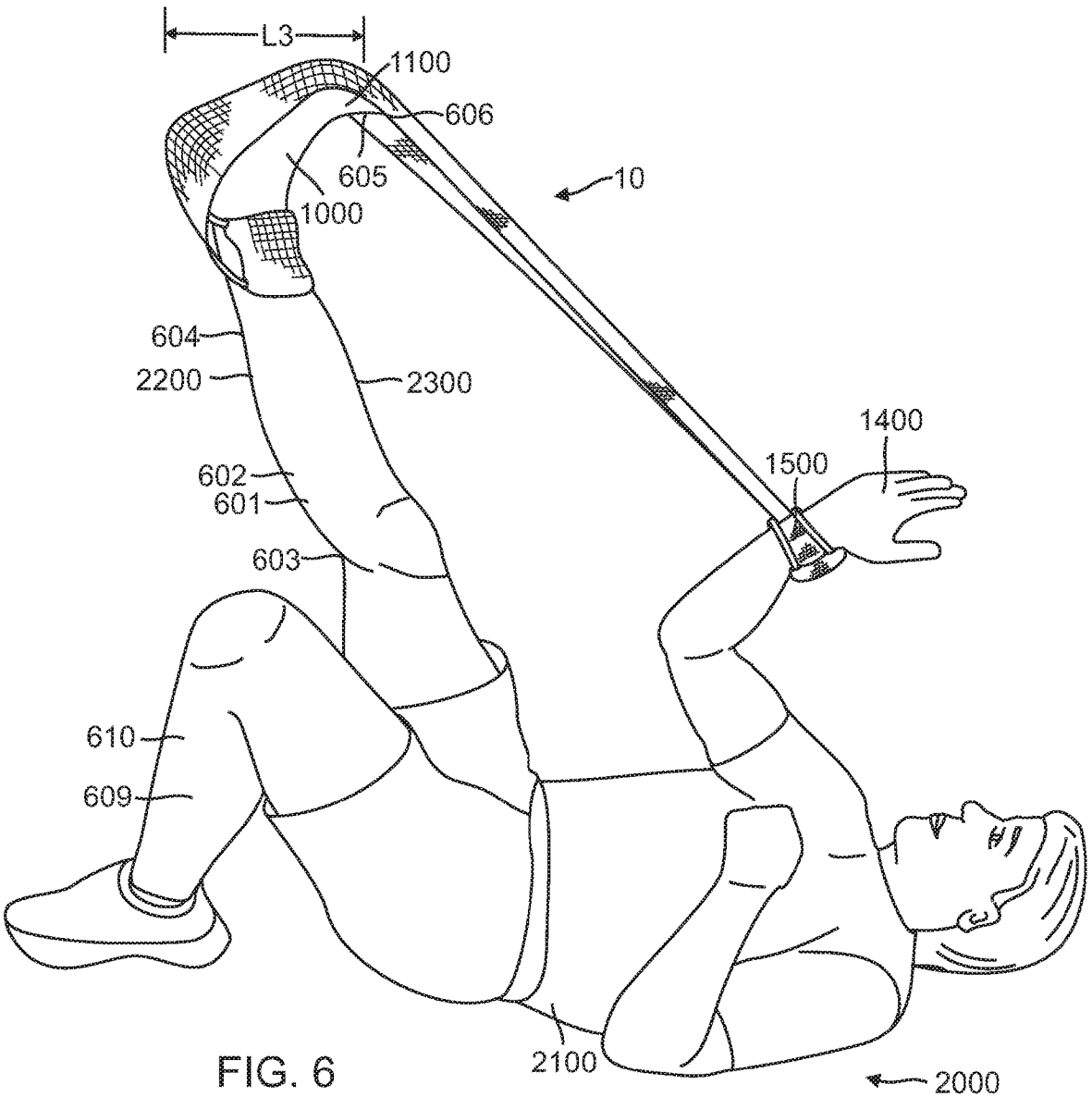
FIG. 6 is a side perspective view of the present invention taken from the view illustrated in FIG. 5, with a person lying on his back with a hand and wrist extending through the second opening and the length of cloth adjacent the second end wrapped around the person's wrist.

Referring to FIG. 6, there is illustrated a side perspective view of the present invention exercise apparatus 10 taken from the view illustrated in FIG. 5, with a person 2000 lying on his back 2100 with a first hand 1400 and first wrist 1500 extending through the second cloth opening 52 and the length "L4" of cloth 12 adjacent the second end 40 wrapped around the person's wrist 1500.

Figure 7:
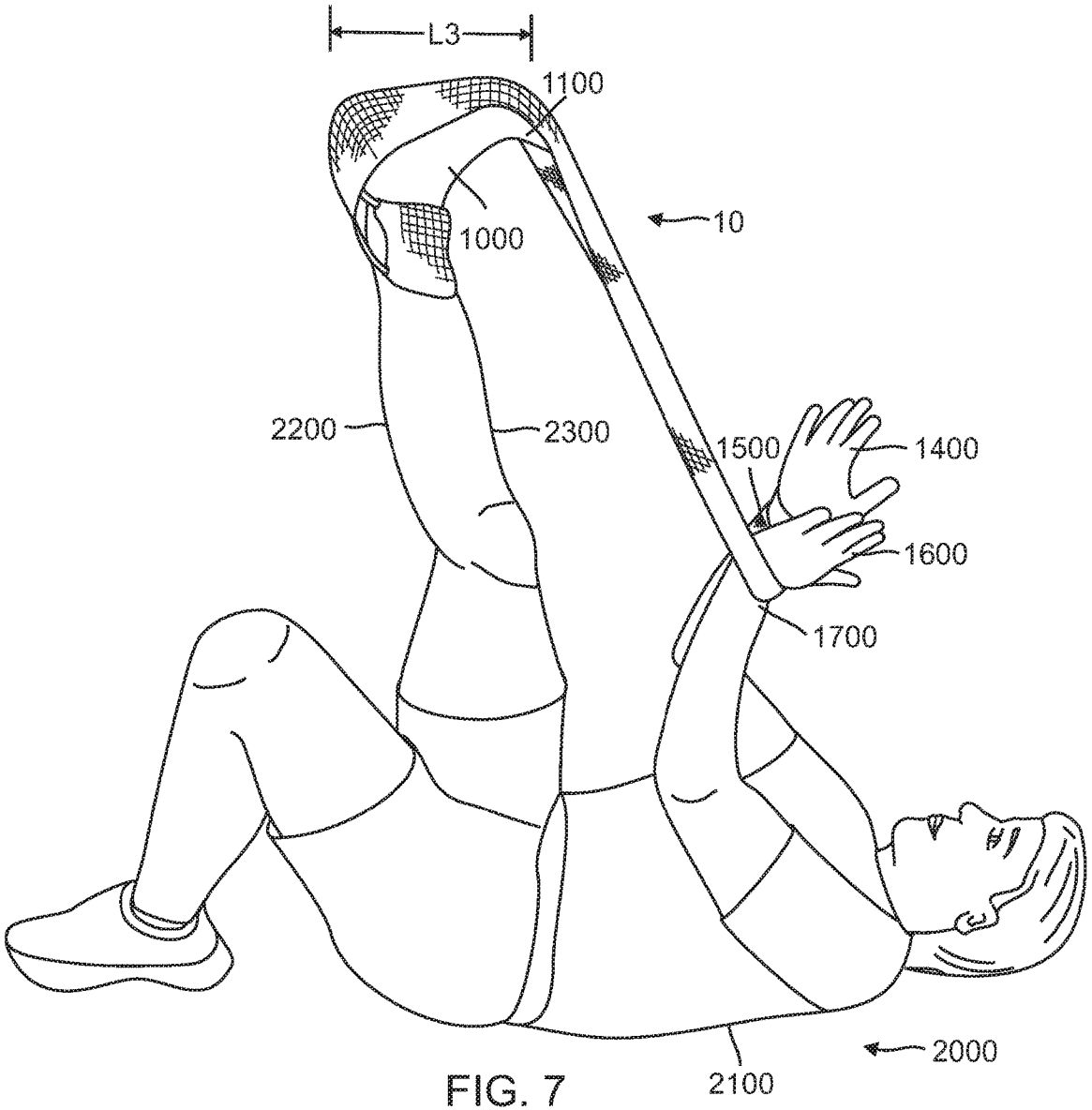
FIG. 7 is a side perspective view of the present invention taken from the view illustrated in FIG. 6, with a person lying on his back with both hands and each respective wrist extending through the second opening and the length of cloth adjacent the second end wrapped around both of the person's wrists.

Referring to FIG. 7, there is illustrated a side perspective view of the present invention exercise apparatus 10 taken from the view illustrated in FIG. 6 with a person 2000 lying on his back 2100 with a second hand 1600 and second wrist 1700 adjacent the section of cloth wrapped around the first wrist 1500, the length "L3" of cloth 12 extending from the ankle 1100 around the heel 1200 of the foot 1000 and under the foot 1000 and past the toes of the foot.

The primary focus and benefit of the present invention flexible non-stretchable strap 10 is to stretch muscles, tendons and ligaments identified as numbers 601 to 611 in the drawings. However, the present invention is capable of stretching and lengthening all types of post structures of the leg, which includes lengthening a muscle.

The specific tendons and ligaments which are stretched are identified in FIGS. 3, 5, 6 and 7 as follows:

Referring to FIG. 6, there is illustrated the gastrocnemius or calf muscle 602, the soleus calf muscle on the posterior portion of the leg. Also stretched is the popliteus 603 behind the knee and the tibialis posterior 604 above the ankle. Also stretched referring to the toes as illustrated in both FIG. 6 and as well as FIG. 3 are the flexor digitorum longus which are the toes identified as item 605 in FIG. 3 which stretches from the location identified as 605 to 605A and also the flexor hallicus longus (great toe) which stretches from item 606 shown in FIG. 3 to 606A shown in FIG. 3. Also referring to FIG. 5, there is illustrated the achilles tendon 607 which stretches to 607A. Also referring to FIG. 5 it also stretches the plantar fascia 608. Also stretched is the peroneus brevis 609 and the peroneus longus 610. Also stretched is the plantar aponeurosis 611. Therefore, the ligaments and tendons to be stretched are selected from the group consisting of the gastrocnemius, the soleus calf muscle, the popliteus, the tibialis posterior, the flexor digitorum longus, the flexor hallicus longus, the achilles tendon, the plantar fascia, the peroneus brevis, the peroneus longus and the plantar aponeurosis.

Figure 8:
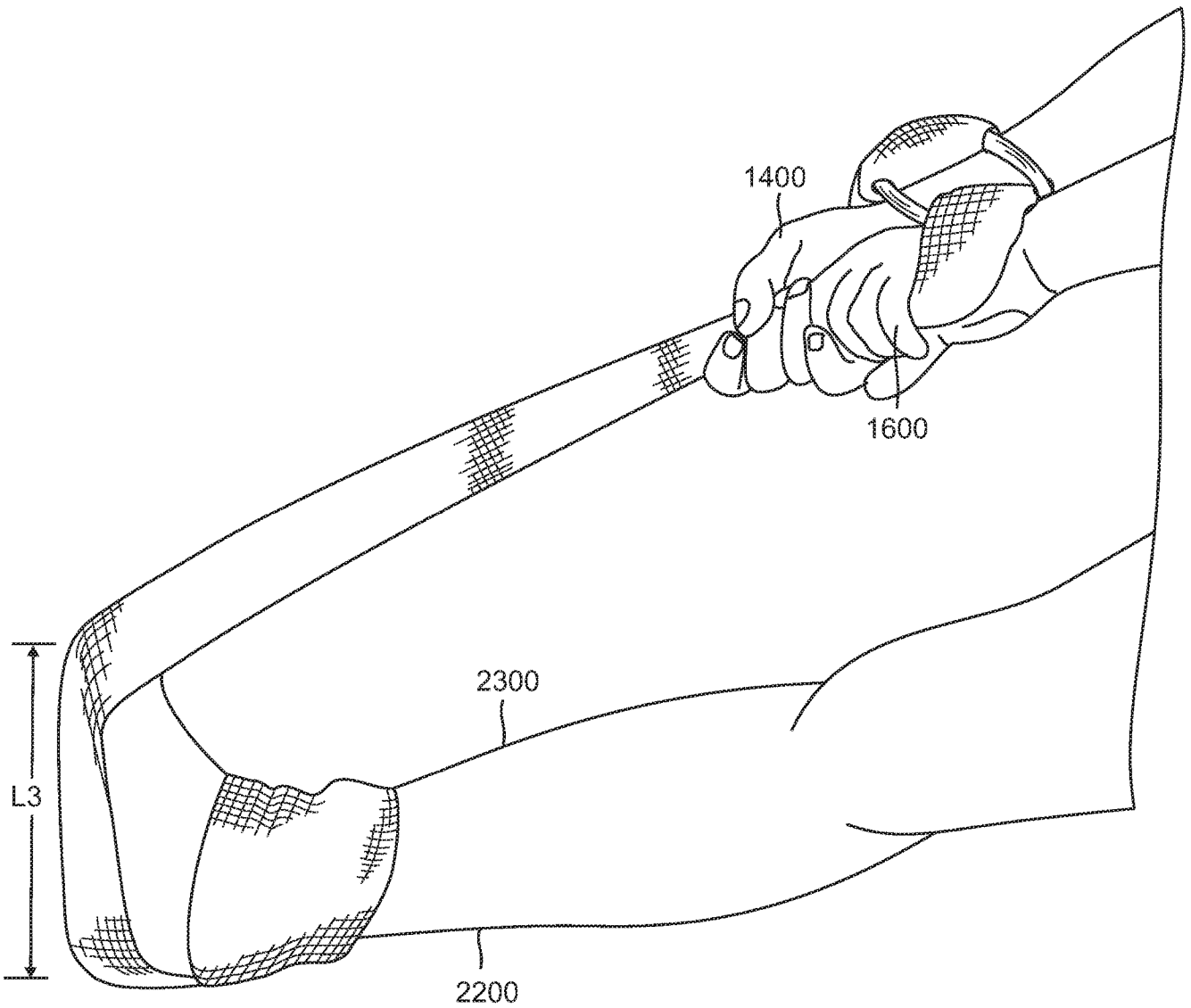
FIG. 8 is a side perspective view of the present invention taken from the view illustrated in FIG. 6, with a person lying on his back with both hands and each respective wrist extending through the second opening and the length of cloth adjacent the second end wrapped around both of the person's wrists with the person grasping an adjacent length of cloth with both hands to pull on the cloth and stretch calf muscles on the leg.
Figure 9:
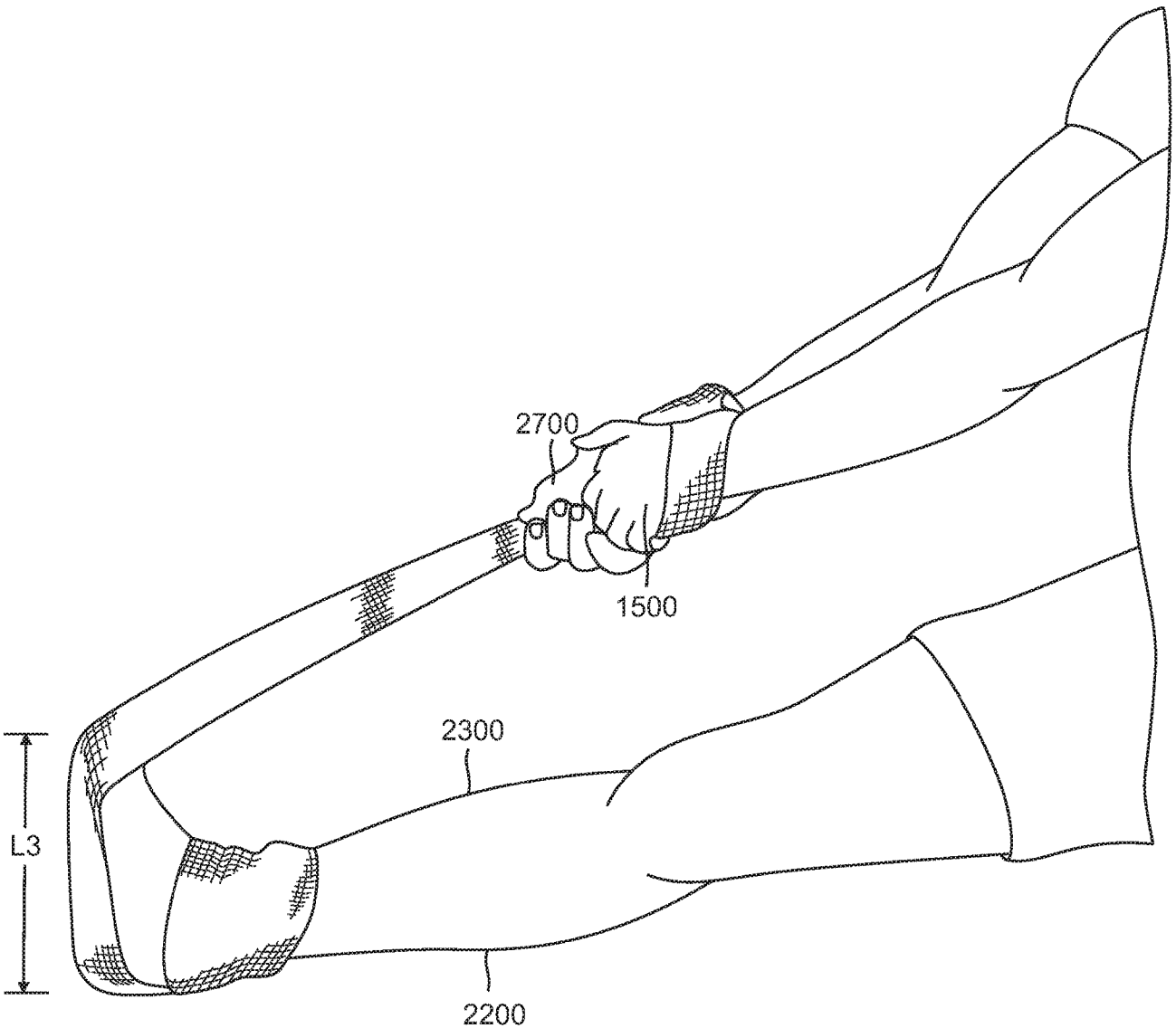
FIG. 9 is a more detailed view of FIG. 8 illustrating the arms and hands, with a person lying on his back with both hands and each respective wrist extending through the second opening and the length of cloth adjacent the second end wrapped around both of the person's wrists with the person grasping an adjacent length of cloth with both hands to pull on the cloth and stretch calf muscles on the leg.

Referring to FIGS. 8 and 9, there is illustrated a side perspective view of the present invention exercise apparatus 10 taken from the view illustrated in FIG. 7, with a person lying on his back with both hands grasping the cloth 12 adjacent the section of cloth with a first wrist extending through the second opening 52 and the length of cloth "L4" adjacent the second end 40 wrapped around the person's wrist 1500 with the second hand 1600 grasping an adjacent length of cloth and the first hand 1400 over the second hand 1600 with both hands 1400 and 1600 pulling on pull on the cloth 12 as the length "L3" of cloth 12 extends from the ankle 1100 around the heel 1200 of the foot 1000 and under the foot 1000 and past the toes of the foot so that the calf muscles 2200 of the leg 2300 are stretched because the cloth 12 does not expand as the pulling force from both hands 1400 and 1600 pull on the cloth 12.

Figure 10:
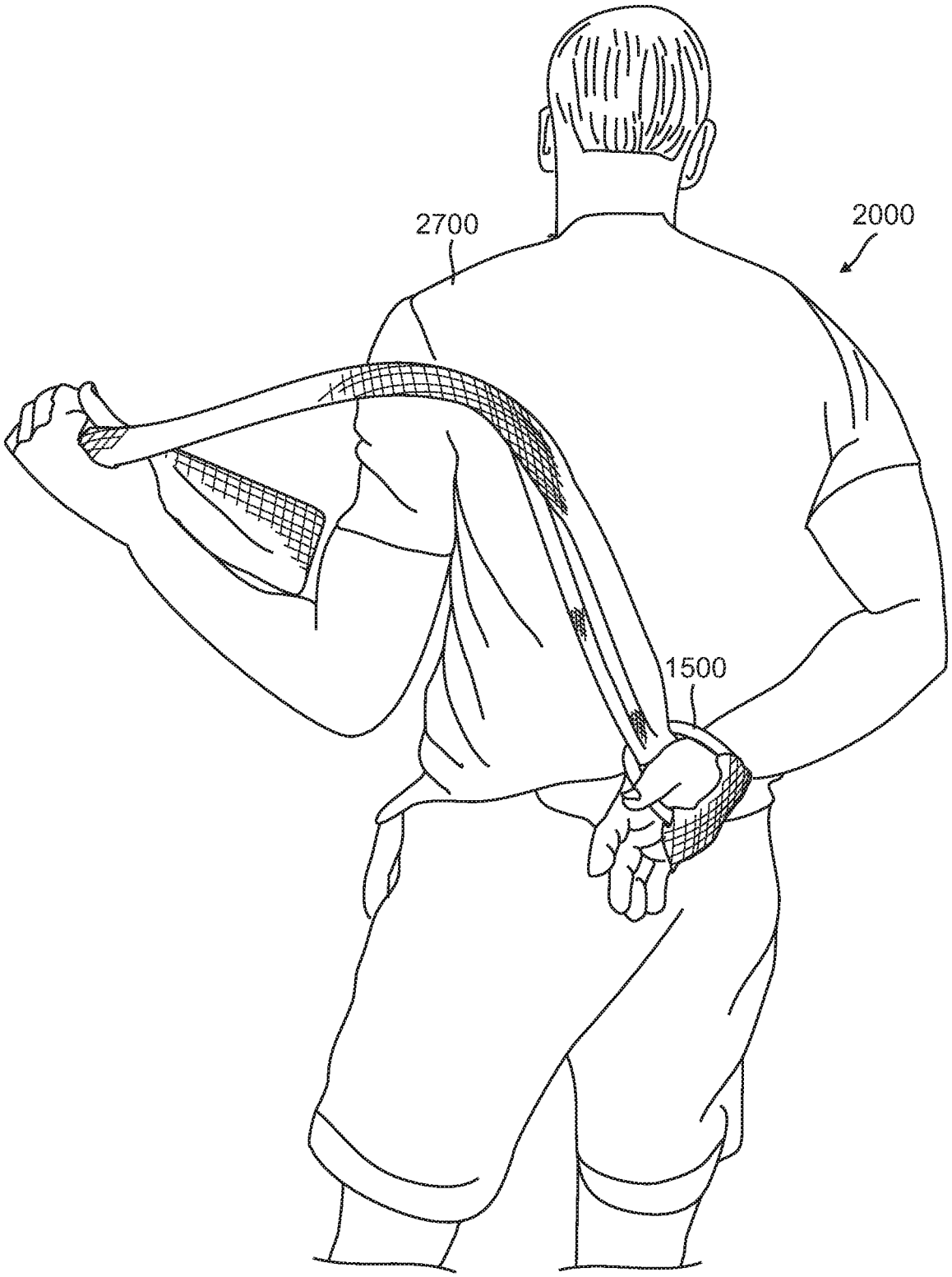
FIG. 10 is a rear perspective view of the present invention with a first wrist extending through the first opening and the person grasping the cloth adjacent the second end.

FIG. 10 is a rear perspective view of the present invention 10 with a first wrist 1500 and first hand 1400 has a length of cloth 12 partially wrapped around them with the thumb 1410 of the first hand 1400 extending through first opening 37 of first arcuate retaining member 30 and a length of cloth 12 grasped by the second hand 1600 and pulled over a person's shoulder extending through the first opening and the person grasping the cloth adjacent the second end.

Figure 11:
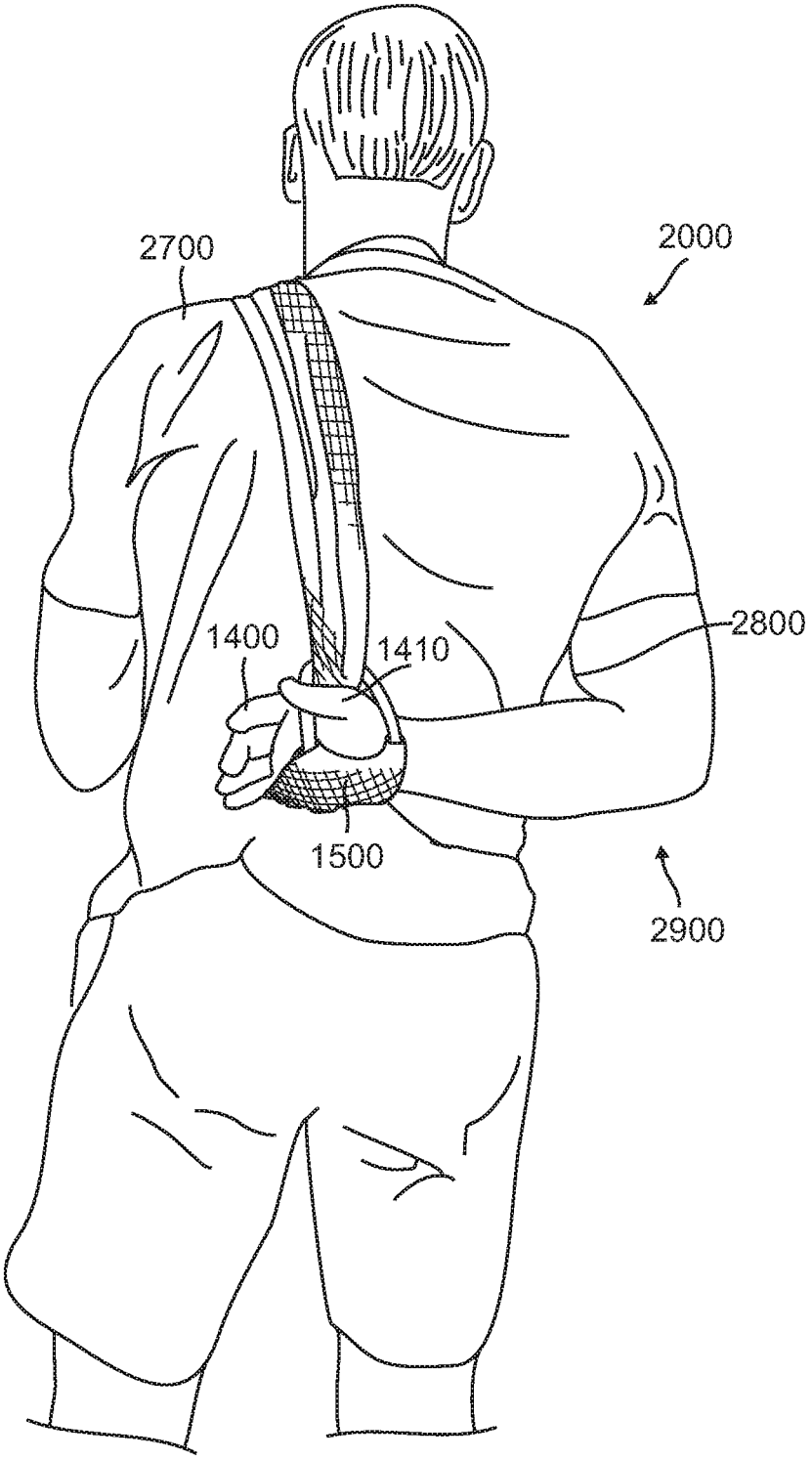
FIG. 11 is a rear perspective view taken from FIG. 9 illustrating the present invention used to stretch an arm muscle.

FIG. 11 is a rear perspective view taken from FIG. 10 illustrating the present invention 10 used to stretch an arm muscle 2800 of arm 2900 which has the first hand 1400 and first wrist partially enwrapped in the cloth 12.

The apparatus 10 is used for stretching exercises including the examples in FIGS. 2 through 9 and FIGS. 10 and 11. The cloth being flexible o enable the cloth to be configured to be wrapped around a body part and then remain taut by at least one hand and preferably both hands are used to stretch the muscle of the body part.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to enable stretching exercise, comprising:

a. a length of non-stretchable cloth material having a first end and a second end, having a first interior channel adjacent the first end and having a second interior channel adjacent the second end;

b. a first arcuate closed loop retaining member having a first opening surrounded by a curved section with integrally formed side sections with a straight base section integrally formed with and retained between the side sections, the straight base section retained within the first interior channel;

c. a portion of the length of non-stretchable cloth material folded back on itself and inserted through the first opening of the first retaining member to create a first cloth retaining member opening with a size of an opening of the first cloth retaining member opening adjustable based on the amount of the length of non-stretchable cloth extending through the first opening of the first retaining member;

d. a second arcuate closed loop retaining member having a second opening surrounded by a curved section with integrally formed side sections with a straight base section integrally formed with and retained between the side sections, the straight base section retained within the second interior channel;

e. a second portion of the length of non-stretchable cloth material folded back on itself and inserted through the second opening of the second retaining member to create a second cloth retaining member opening with a size of an opening of the second cloth retaining member opening adjustable based on the amount of the length of cloth extending through the second opening of the second retaining member;

f. the first retaining member is made out of soft fabric material; and g. the second retaining member is made out of soft fabric material.

2. The apparatus to enable stretching exercise in accordance with claim 1, further comprising: the length of non-stretchable cloth is made of material selected from the group consisting of cotton, terry cloth, wool, felt, and non-stretchable neoprene.

3. An apparatus to enable stretching exercise, comprising:

a. a length of non-stretchable cloth material having a first end and a second end, having a first interior channel adjacent the first end and having a second interior channel adjacent the second end;

b. a first arcuate closed loop retaining member having a first opening surrounded by a curved section with integrally formed side sections with a straight base section integrally formed with and retained between the side sections, the straight base section retained within the first interior channel;

c. a portion of the length of non-stretchable cloth material folded back on itself and inserted through the first opening of the first retaining member to create a first cloth retaining member opening;

d. a second arcuate closed loop retaining member having a second opening surrounded by a curved section with integrally formed side sections with a straight base section integrally formed with and retained between the side sections, the straight base section retained within the second interior channel;

e. a second portion of the length of non-stretchable cloth material folded back on itself and inserted through the second opening of the second retaining member to create a second cloth retaining member opening;

f. the first retaining member is made out of soft fabric material; and g. the second retaining member is made out of soft fabric material.

4. The apparatus to enable stretching exercise in accordance with claim 3, further comprising: the length of non-stretchable cloth is made of material selected from the group consisting of cotton, terry cloth, wool, felt, and non-stretchable neoprene.

* * * * *